US009186705B2

(12) United States Patent
Benedetti

(10) Patent No.: US 9,186,705 B2
(45) Date of Patent: Nov. 17, 2015

(54) PLANT FOR SELECTION OF CRATES FOR VEGETABLE PRODUCTS ACCORDING TO THEIR DEGREE OF CLEANLINESS

(75) Inventor: Luca Benedetti, Savarna (IT)

(73) Assignee: UNITEC S.P.A., Lugo (RA) (IT)

( * ) Notice: Subject to any disclaimer, the term of this patent is extended or adjusted under 35 U.S.C. 154(b) by 0 days.

(21) Appl. No.: 14/236,179

(22) PCT Filed: Sep. 14, 2012

(86) PCT No.: PCT/EP2012/068136

§ 371 (c)(1),
(2), (4) Date: Jan. 30, 2014

(87) PCT Pub. No.: WO2013/041463

PCT Pub. Date: Mar. 28, 2013

(65) Prior Publication Data

US 2014/0144818 A1 May 29, 2014

(30) Foreign Application Priority Data

Sep. 21, 2011 (IT) ..... PN2011A0061

(51) Int. Cl.

| | |
|---|---|
| ***B07C 5/00*** | (2006.01) |
| ***B07C 5/34*** | (2006.01) |
| ***B07C 5/342*** | (2006.01) |
| ***B07C 5/02*** | (2006.01) |

(52) U.S. Cl.

CPC ..... *B07C 5/3404* (2013.01); *B07C 5/02* (2013.01); *B07C 5/342* (2013.01)

(58) Field of Classification Search

CPC ..... B07C 3/003; B07C 3/006; B07C 3/008; B07C 3/08; B07C 5/00; B07C 5/34; B07C 5/3404; B07C 5/342; B07C 5/36; B07C 2501/00; B07C 5/02

USPC ..... 209/552, 576

See application file for complete search history.

(56) References Cited

FOREIGN PATENT DOCUMENTS

| | | | |
|---|---|---|---|
| DE | 10021802 | A1 | 2/2002 |
| WO | 2006/118943 | A1 | 11/2006 |
| WO | 2011/061097 | A1 | 5/2011 |

*Primary Examiner* — David H Bollinger

(74) *Attorney, Agent, or Firm* — Birch, Stewart, Kolasch & Birch, LLP

(57) ABSTRACT

Plant for the selection of crates, in particular for vegetable products, comprising: transferring means, preferably a continuous conveyor suitable for suitable for transferring said crates in an orderly, continuous and sequential manner, a station for measuring the degree of cleanliness of said crates, comprising measurement and control means suitable to detect the cleanliness degree of said crates, and arranged in an intermediate position in the path of said transferring means. Loading means are provided suitable to reassemble said crates in respective stacks based on their degree of cleanliness measured on each of them, wherein said loading means are arranged downstream of said measuring station and wherein said transfer means supply said loading means, without intermediate stations or processes. In addition, the plant includes a station for aligning the crates on said transfer means in a position stacked upstream of said measuring station. The measuring station is suitable to measure the degree of cleanliness of crates with collapsible walls when said crates are closed.

15 Claims, 7 Drawing Sheets

PLANT FOR SELECTION OF CRATES FOR VEGETABLE PRODUCTS ACCORDING TO THEIR DEGREE OF CLEANLINESS

The present invention concerns an improved plant for the selection of containers, especially crates used specifically for the collection of vegetable products, particularly fruit, based on their degree of cleanliness.

Based on the data on the relative degree of cleanliness, a calibrated washing procedure is implemented for each individual container.

The requirement and technology to examine the degree of cleanliness of these types of containers, and to carry out the relative washing process, are well known in the art. In this regard, reference is made herein to Italian patent (application) No. PN 2009 A000068 and to the prior patents mentioned therein.

However, for the sake of brevity, and of convenience for the reader, herein is mentioned the general context that is at the basis of the necessity of washing said containers and of applying the most common washing processes and systems.

It is well known that said types of containers are used directly in the fields and at any rate in close contact with the soil, so that they can be filled with the fruit during the relative fruit harvesting.

Hence, these containers must be carried, handled, filled in a rather rough manner, and are often dragged on the ground or set down on the soil.

In addition, during their use, and particularly while they are being filled and carried, they are inevitably soiled or contaminated with various agents, such as, mainly, semiliquid material that drips and becomes separated directly from the produce, and that often dries into sugar that can favour the formation of spores, moulds, etc., but also parts removed from the collected fruit, or other agricultural contaminating agents, wood slivers, leaf fragments, etc.

As it is necessary, and also imposed by regulatory requirements, that these containers used subsequently on the processing lines for packaging the selected products be strictly cleaned of any residue from the previous collection and processing, it is a common and mandatory practice to submit the same containers to a cleaning or washing treatment.

This is carried out according to the known art, through two alternative methods:

- either by providing a continuous conveyor consisting of a succession of transfer and conveying means suitable for transferring the crates in an orderly sequential manner through a suitable washing tank;
- or by providing and using different sets of spraying nozzles to spray the washing liquid toward the same crates, in a manner similar to the methods used in car washing plants.

Said conveying means are used by a succession of containers that are thus carried, in a corresponding orderly manner, to be immersed in a washing tank.

At the end of said washing operation, the containers are removed from the washing tank to be released and be made available to be used again.

The crate washing operation is a simple and safe process and offers a full assurance of its effectiveness.

However, this operation of washing every individual crate, presents in a significant number of circumstances some specific drawbacks, as explained below.

First of all, it must be remembered that crate washing plants are rather demanding plants, from the economic and operating point of view, and also due to their space requirements.

On the other hand, in many cases it is also commonly observed in the field that in many cases grossly soiled crates are brought in to be reused, and thus to be properly washed, along with crates that are completely or substantially clean, for which a washing cycle would be unnecessary and needlessly costly.

To obviate said problem, treatment plants have been conceived that measure the degree of cleanliness of each crate, and to carry out the washing cycle only on those crates that display an unacceptable degree of cleanliness.

Thus said plants are certainly very costly because they comprise in fact an apparatus for measuring the degree of cleanliness of each individual container and for handling each container according to the degree of cleanliness measured.

For the purpose of reducing said costs, a situation has been progressively determined wherein common crate collecting and treatment centres are provided, for both clean and dirty crates, newly returned from the end users, wherein said collecting centres "process" said crates not for just one user but for a plurality of different end users.

Subsequently, all the crates, once cleaned, are sent to the individual different users depending on their respective requirements.

This mode of operation, in itself advantageous because it makes it possible to combine the cost of a single selection and washing centre, in actual practice has however shown itself to be rather complex both because the cost of the operations for measuring the degree of cleanliness of all the crates, their subsequent selection, and the washing of only some of said crates has proven to be high, and most of all for operating reasons, because, in order to be efficient said plants must "process" large numbers of crates, especially to wash them, whereas it frequently happens that only small lots are sent there, which however need to be immediately washed because the end customer requires them to be available in very short order.

This results in a "rigid" operating mode that is very disadvantageous, due to the evident lack of synchronization between different and conflicting requirements.

Thus it must also be considered that the greater cost of a complete plant for measuring the degree of cleanliness, selecting and handling, and also washing the crates, does not weigh on the part of said plant that performs only the measurement of the degree of cleanliness, but on the rest of the plant, that is, on the part of the same that carries out the selective handling of the crates, and their relative washing.

Therefore, it was considered advisable to assess the possibility and the advantages, from every point of view, including from the point of view of productive flexibility, that the sequence of operations on all the crates received to be "processed" be separated in two different plants, and specifically:

- in a central, common plant wherein only the degree of cleanliness of the crates is measured; and in another plant wherein are selected and grouped differently, in particular in normal stacks, those crates that are already sufficiently clean and that do not need to be washed, separately from those crates that must first be washed.

These stacks are then sent to the end user, who provides on his own to use only the clean crates.

Although it may be objected that a local washing plant has its own cost, a strong and decisive consideration can be made that this can substantially eliminate the productive rigidity explained earlier, with evident and significant economic advantages.

It would therefore be desirable, and it is the main objective of present invention, to be able to realize a type of automatic plant for measuring the degree of cleanliness of a plurality of generally stacked crates, like normal produce boxes, and in particular closed-type boxes, particularly for fruit and vegetable products, suitable to carry out a selection in different physical combinations, typically stacked, wherein each of said stacks contains all and only those crates that must subsequently be treated in the same manner; that is, the crates from a first stack, can be sent directly to their intended use, while the crates from a second stack must all be first washed, without undergoing any handling or further selection.

This objective is achieved by a plant realized and operating according to the accompanying claims.

Characteristics and advantages of the invention will become evident from the description which follows, given by way of non-limiting example, with reference to the enclosed drawings, wherein.

Figure 2:
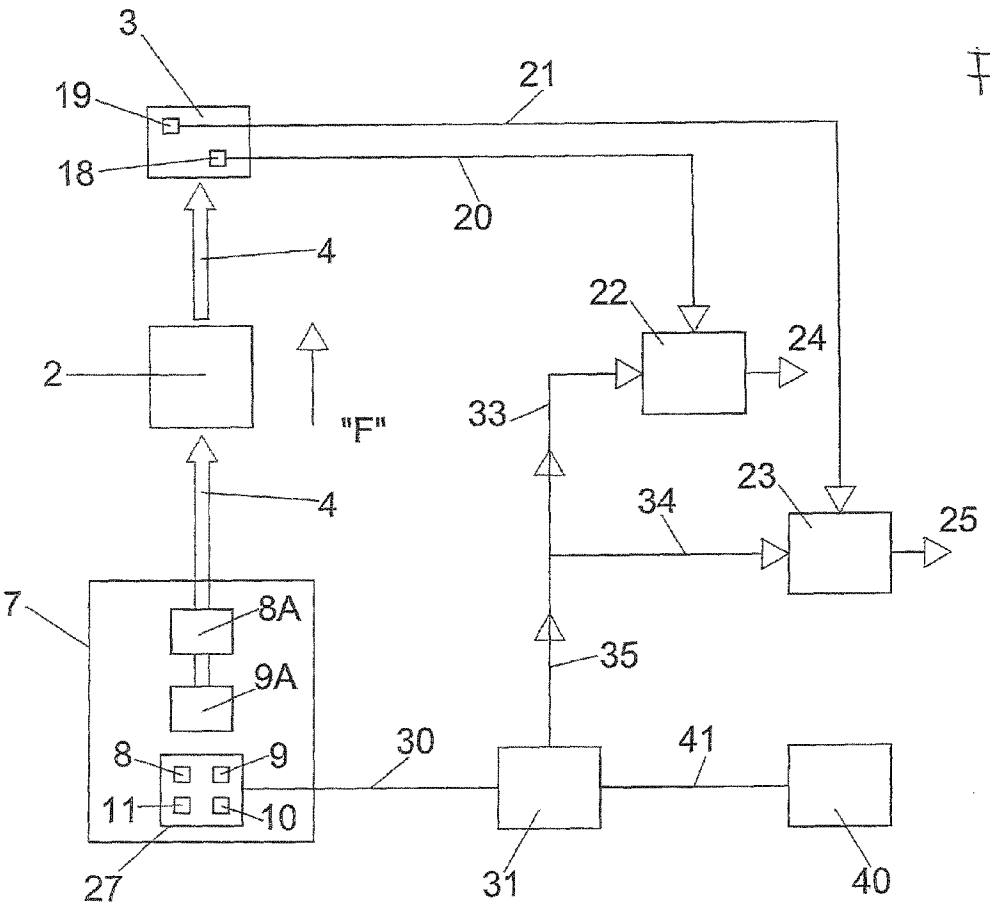
FIG. 2 is schematic plane view from above of a more complete embodiment of the plant of FIG. 1.
Figure 2A:
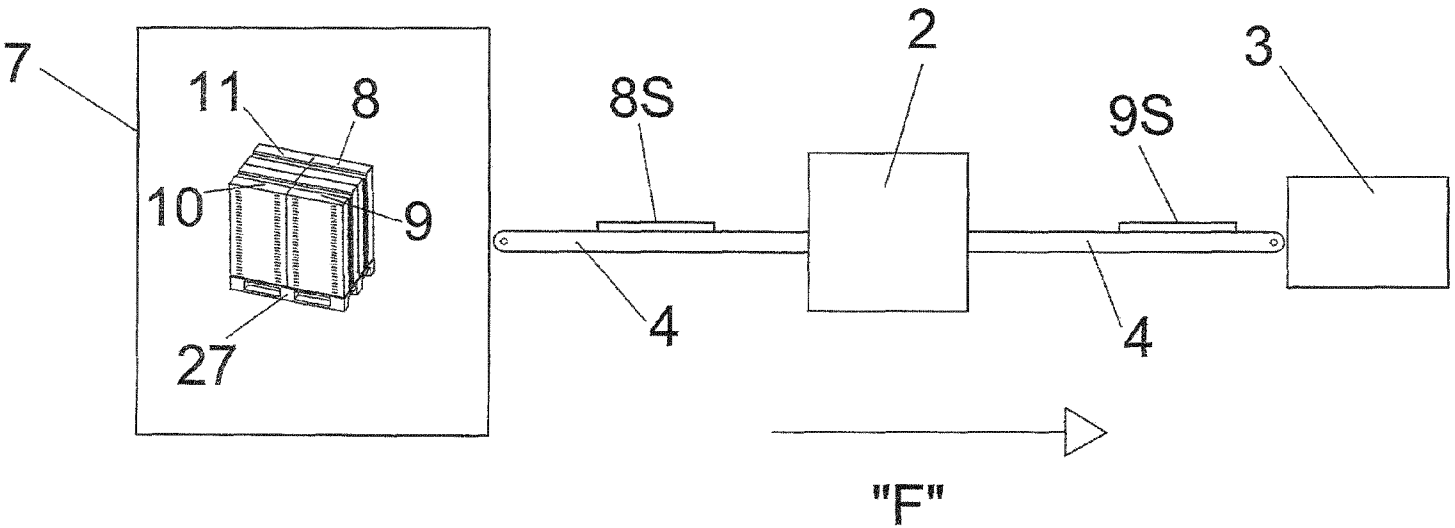
Figure 3:
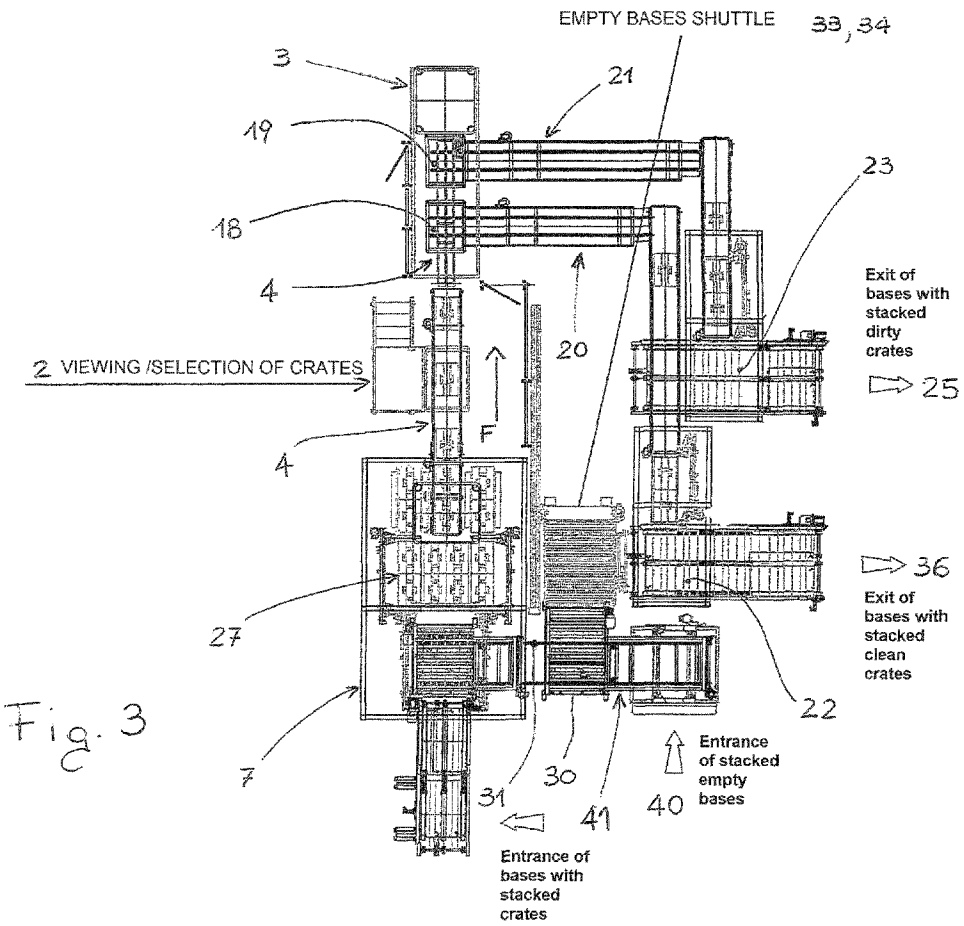
Figure 4:
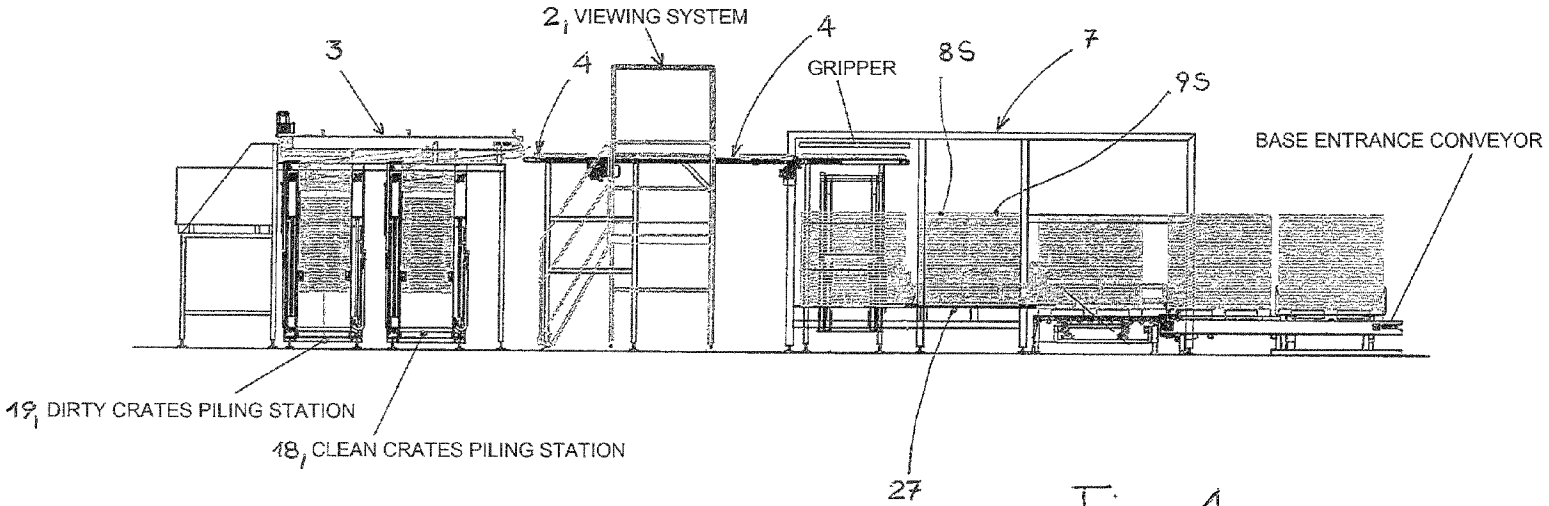
Figure 5:
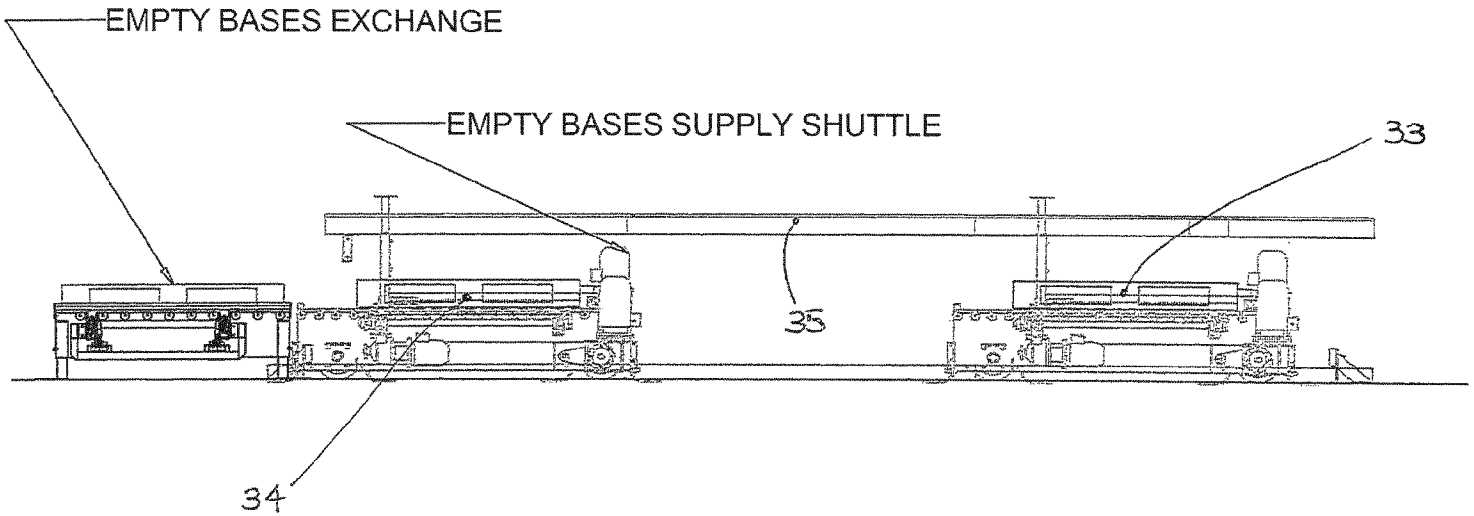
Figure 6A:
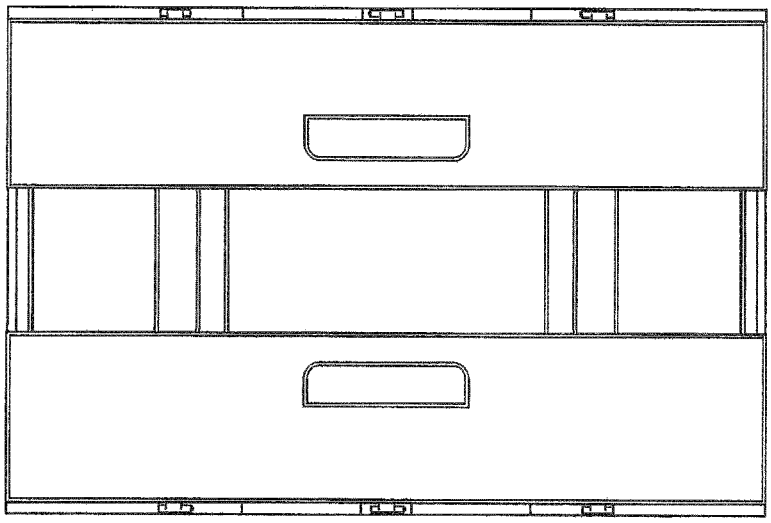
Figure 6:
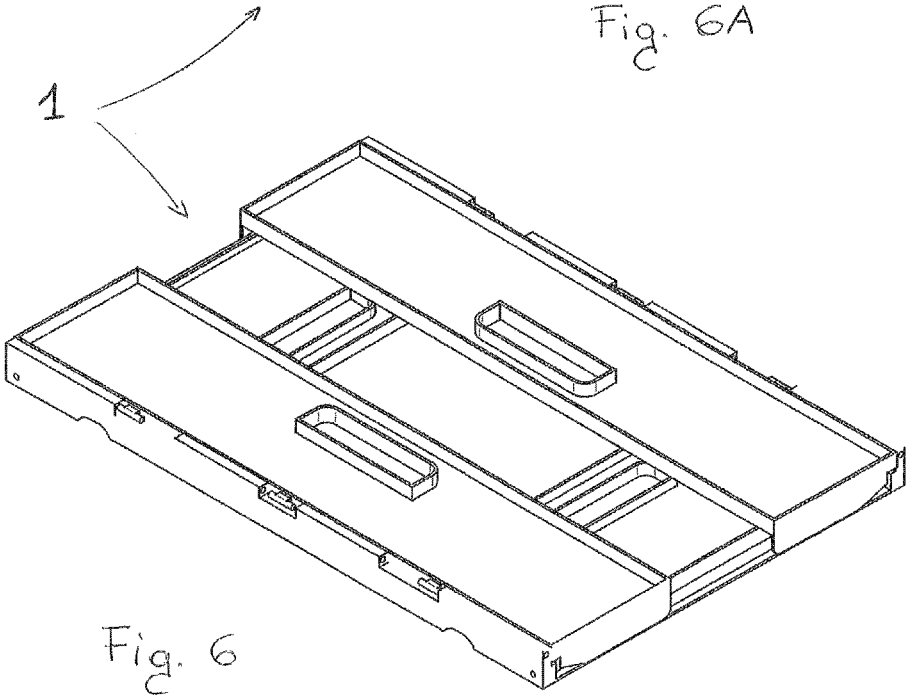

FIG. 2A is a perspective view with a symbolic representation of one portion of the plant of FIG. 2, FIG. 3 illustrates a plane view from above of the plant of FIG. 2, with the constructive and functional elements shown in symbolic form, FIG. 4 illustrates a side view of the plant of FIG. 3, seen from the point of view indicated by the arrow "A" of FIG. 3, FIG. 5 illustrates a side view of a part of the plant of FIG. 3, indicated by the closed dashed line "L" of FIG. 3, FIGS. 6 and 6A illustrate two views of a crate with the walls folded in, and thus closed, used by a plant according to the invention, shown respectively in a perspective view and in a plane view from above.

Figure 1:
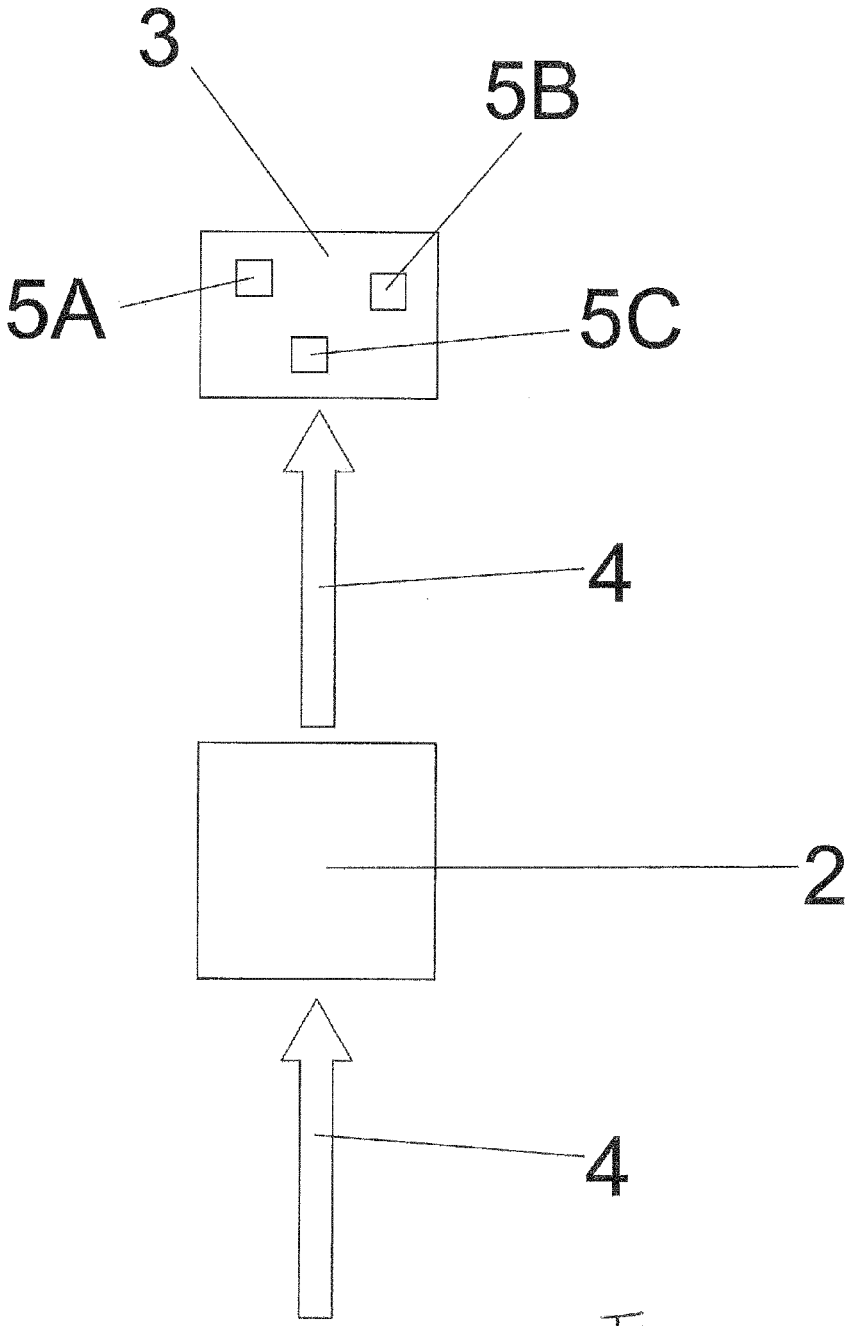
FIG. 1 is a schematic plane view from above of a plant modified and improved according to the invention.

With reference to FIGS. 1 and 2, a plant for the selection of containers, particularly crates, both open and, preferably, closed, for vegetable products, suitable to measure the degree of their cleanliness according to the known art includes:

- conveying means, preferably a continuous conveyor 4 suitable for transferring said crates in an orderly, continuous and sequential manner;
- a measuring station 2 for measuring the degree of cleanliness of said crates, comprising measuring and control means, not specifically shown, suitable to detect the cleanliness of said crates, and arranged in an intermediate position in the path of said continuous conveyor 4.

Said means for measuring the degree of cleanliness of the crates are known in the art, and are also described in the patents mentioned above; for this reason, a detailed and unnecessary description of the same is omitted.

Herein it is only specified, as will be better explained below, that said means are capable of:

- storing a plurality of data corresponding to respective predefined degrees of cleanliness;
- comparing similar data relative to the cleanliness degree of an examined crate;
- and then classifying said crate according to the result of said comparison.

This methodology is also generally known in the art, for example in the field of quality control.

According to the present invention, suitable loading means are provided, arranged in a suitable piling station 3, suitable to reassemble said crates in respective stacks 5A, 5B, 5C, . . . , after they have been measured in said measuring station 2 and after they have been removed from said conveyor 4.

Said loading means are arranged downstream of said measuring station 2, and said conveyor 4 feeds directly said piling station 3, without intermediate stations or processes, so that this station can then handle said crates in succession and assemble them, setting them down in an orderly manner on said respective stacks 5A, 5B, 5C, . . . .

According to a universally known process control mode, the value produced by said measuring means is sent to a known command and control means, not shown, in which were previously stored defined intervals, each of which corresponding to a respective cleanliness degree.

The value generated by said measuring means is then compared with one of said intervals already stored in said command and control means.

Depending then on the result of this comparison, the respective crate is "classified", that is, a consequent signal is sent to a relative memory register that stores said classification and matches it with a definite crate, naturally in the sense that the position of a crate in motion is in reality associated with the crate itself.

At this point, this crate is "indexed", that is, each crate is matched with the respective classification.

Finally, each crate is removed from said conveyor by said loading means, which assemble each crate on a relative stack exclusively on the basis of its respective classification.

In short, each of said stacks receives and is formed exclusively by all the respective crates, on the basis of their relative classification, and thus of the degree of cleanliness measured on each of them.

In essence, if only one interval has been defined relative to a cleanliness degree that varies upwards from a given value (and obviously an alternative cleanliness degree that starts from the same value, only in this case downwards, is automatically defined), two different stacks will be obtained: one that contains only "clean" crates, and one containing only "dirty" crates.

It will be seen that the intention in the previous description was to disclose the basic structure of the plant of the invention, without probing into the merits of specific constructive solutions.

It should be pointed out that the basic characteristic of the invention is not to realize a washing plant, but rather a plant designed to exclusively carry out the selection of crates based on their degree of cleanliness, in which said plant explicitly excludes any washing step or means.

Thus, said plant carries only the selection and subsequent reassembling of the crates, based on their respective degrees of cleanliness.

Therefore, on the type of plant as generally described above various advantageous improvements are possible:

1) With reference to FIGS. 2 and 2A, upstream of said measuring station 2, and substantially at the beginning of said continuous conveyor 4, is arranged a crate aligning station 7, suitable for placing the crates in a subsequent position on said conveyor; in this manner it is possible for the conveyor, moving in a continuous mode, to carry at subsequent moments the individual crates to the measuring station 2, thus avoiding any interruption of the process.
2) With reference to FIG. 2 and subsequent ones, the following improvement is achieved, with the objective of achieving a preferred embodiment of the invention; this consists of classifying and dividing the crates in only two categories, that is, dirty crates and clean crates.
   The final purpose of this subdivision is evident, and consists of sending to a subsequent washing phase only the stacks of soiled crates, thus completely avoiding any further processing of the stacks of clean crates.
   This result is achieved by starting first of all from the premise that the crates coming from said crate aligning station 7 are piled in a plurality of stacks, and that said stacks are in turn set down and carried by respective support platforms or bases 27.

In particular, each of sad bases supports and carries four of said stacks identified as 8, 9, 10 and 11, orderly arranged inside the perimeter of the relative base, generally of rectangular shape, as shown symbolically in FIGS. 2 and 2A.

Preferably, each of said stacks is placed alongside another stack so as to generally form a rectilinear and quadrilateral prism that rests on the same base 27, but naturally other forms of association between the various crate stacks and the relative base cannot be excluded, although this lies outside the purpose of the present invention.

Further, each stack is made up of an equal number of crates; consequently said stacks have the same height.

The present inventive improvement consists of the fact that particular engaging and transfer means are arranged, in particular a pair of "grippers" suitable to:

be lowered from directly above two stacks arranged on the same base;

grip simultaneously the two upper crates 8S, 9S (which are preferably on the same level) of the respective two stacks 8 and 9;

collecting them, lifting them and then separating them from the respective stacks;

and transfer them, possibly with a combined rotational/translational motion, on said continuous conveyor 4.

In fact, it may be that, as explained above, said stacks are placed next to each other; to space them apart of the conveyor 4 different methods known in the art are available and can be used. For example, the crates are preferably collected in pairs, and said pairs of crates are both set down on an intermediate conveyor when they are still attached to each other. They are then immediately transferred automatically from the first conveyor to a second conveyor travelling at a greater speed, which naturally separates them from each other, based on the well-known relation:

$$s(\text{space})=v(\text{speed})\cdot t(\text{time})$$

If the relative speed between two objects is increased, their relative distance will increase in a given time.

Thus, the two crates 8S, 9S placed on the conveyor at the same time will be separated from each other in the direction of travel of the conveyor, as shown symbolically by the arrow "F" in FIGS. 2 and 2A.

Alternatively, if the crate pairs arranged on the same base are placed on the conveyor 4 adjacent to each other, as it often happens in actual operation because in this manner they take up less space between them, then means and operating procedures are provided to separate said stacks from each other, as for example a combination of pushers associated with a conveyor speed control, etc.

This point is not discussed further because the means for separating two bodies that are to be routed on the same conveyor are numerous and well known, and lie outside the scope of the present invention.

This therefore provides the positive result that:

the crates are collected together one pair at a time, thus speeding up the operation of feeding the crates on said conveyor 4;

moreover, the crates are already prearranged on said conveyor to be measured in an orderly fashion and in sequence because, although they are set down on the conveyor at the same instant, they are and remain spatially separated because that is the way they were arranged by said transfer means or "grippers".

3) Referring again to FIG. 2 and subsequent ones, further positive improvements can be achieved when it is considered that the crates must be classified as simply "clean" or "dirty".

Therefore it is evident that after their cleanliness is measured at the measuring station 2, all the crates are reassembled in only two sets, and in particular they are piled in only two kinds of stacks: a stack of clean crates, and a stack of dirty crates.

Thus, with reference to FIGS. 2A and 3, the stacking station 3 is made suitable to remove the single crates carried by the conveyor 4 and leaving the measuring station 2, and to stack them in only two distinct stacks.

In fact, as already mentioned, every crate is indexed, that is classified on the basis of its degree of cleanliness, and thus it is entirely possible to associate each crate with a definite stack, and in particular with the position in which that stack, which contains only one type of crates, is formed.

For the sole purpose of description, it is here assumed that the stack of dirty crates is the stack 18, and the stack of clean crates is the stack 19; evidently, both are contained in the stacking station 3.

Thus in this stacking station 3, which is downstream of the measuring station 2 and at the exit from the conveyor 4, the crates are stacked again on each other to form said two different stacks 18 and 19.

For the further purpose of guaranteeing that said stacks are subsequently routed correctly and consistently with the objective of the invention, each of said two stacks is always formed in the same part of said piling station 3, so that the transfer of stacks coming from one or the other of said parts itself ensures not only that each of said stacks is made up of crates having the same degree of cleanliness, but that their coming from a given part of said stacking station determines in itself their classification with respect to their cleanliness.

However they are not here set down on respective bases; in fact, the crate alignment station 7 provides to unstacking the individual crates from the respective stack, including naturally the bottom crate, and to setting them down on said conveyor 4.

At the end of the crate unstacking process, the relative base is completely "freed" of all the overlying crates, and thus it must be removed to leave room for a following base, loaded with crates, and that will also have to be unloaded.

Thus, for the purpose of moving said stacks again, it is necessary to provide said two new stacks 18 and 19, containing the already selected crates, with respective underlying bases.

For this purpose, when one of said stacks reaches a definite height or number of crates, sensed by said control means, it is removed from its position and transferred, by known means, and preferably through suitable roller conveyors, slat conveyors, etc., 20 and 21 respectively, to two respective reassembling stations 22, 23.

Said reassembling stations 22, 23 lift the respective incoming stacks and set them down again on respective bases.

Two alternative modes can be followed to provide said bases:

A) in a first alternative (FIGS. 2 and 3), the individual bases that were previously freed in the aligning station 7 are recovered, since, after having been completely unloaded of the respective crates, each base is empty again, and thus can be immediately used again.

For this purpose, said station 7 is also provided with suitable means for moving empty bases, indicated by numeral 30, suitable to transfer the bases to a base supply station 31.

Thus, as the bases are freed, they are transferred by said transferring means 20 to said station 31.

In this station, said bases are held until at least one of said reassembling stations 22 or 23 is occupied by a new stack, and thus requires a respective base to associate with the newly arrived stack.

In this case, the stack available at that moment in said supply station 31 is transferred, through known transferring means, to one or the other of said two supply stations 22 or 23 through respective transferring means 23 or 34.

With particular reference to FIG. 2, said transferring means can also be provided with a common transfer path or means identified by numeral 35.

The loading of the various stacks with crates on the respective bases, carried out in the two reassembling stations 22 and 23, is also a well-known technology and therefore will not be discussed further.

B) In the second alternative, and still with reference to FIGS. 2 and 3, the base supply station 31 is supplied with bases that can be previously loaded from outside (and therefore with a procedure not pertaining to the present plant) in a new base loading station 40.

In this station 40, the bases arrive already stacked, since they may have been collected and advantageously grouped together separately, in normal manners that are not pertaining to the present invention.

In this manner, since the bases at this station 40 are also available when a new base is requested at the supply station 31, this supply station can receive the base requested by said station 40 through a known base transfer means 41. Preferably, each base extracted from the stack of bases in the station 40 is collected from below, although it may also be collected as the uppermost base of the relative stack.

In addition, it will be clear that the operating orders processed and transmitted by said command and control means, to operate all the devices and actuators described in the present invention, must be organized and processed on the basis of predefined programs/algorithms so that the described operations can be carried out in an ordered succession and according to logic.

For example, the logic that controls the movement of the bases at the base supply station 31 is arranged so as to give priority to the bases coming from the transfer line 30, if any are available; if this is not the case (for example, if the stacks of crates arrive without the bases), then it is determined that said base loading station 40 transfers, in an automatic mode, but naturally synchronized with the pace required for the reassembling stations 22 and 23, the respective bases toward said station 31.

Regardless of how said bases are supplied to the two reassembling stations 22 and 23, each of them carries out automatically and independently the subsequent operation of placing the respective and subsequent stacks of crates, already selected and classified, on respective bases which are requested from said common supply station 31; in fact, this supply station 31 can in turn be supplied both from the stack aligning station 7, or from the base loading station 40; thus there is normally always a base available on said base supply station 31, to be sent, on request, to one of said reassembling stations 22 or 23.

From said stations 22 and 23, the new stacks thus completed are finally supplied externally through additional transfer means, 24 and 25 respectively.

It will also be evident, from the foregoing description, that all the functional devices described, and in particular the stations 7, 3, 22, 23, 40 and 31, which are assigned to carrying out the general operations of transferring both the single crates and the stacked crates, as well as the bases, whether they are stacked or not, must be controlled by the means of command and control already generally defined, which must provide to their coordinated and fail-safe operation.

In fact, it is evident that each of said stations must be able to receive from the preceding station a new unit to process only if it has already transferred to the respective subsequent station the newly processed unit, and therefore it is ready to repeat its operating cycle.

Similarly, said transfer means indicated as 4, 20, 21, 30, 41, 33, 34 and 35 must be controlled in the sense that the stations at the ends of said transfer means must allow the transferring operation from the "upstream" station, which must be full, to the respective "downstream" station, which naturally must be empty.

In this context, said measuring station 2 can also operate, on the whole, independently on the crates that are carried there by said conveyor 4; however, it will also be evident that the stacking station 3 must be provided with means and instructions suitable to load each crate on one or the other of the two stacks 18, 19, depending on how there were previously classified and indexed.

The invention claimed is:

1. Plant for crate selection, especially for vegetable products, comprising:

transferring means for conveying in an ordered, continuous, and sequential way a plurality of crates;

a measuring station for measuring the cleanliness degree of said crates, and located in an intermediate position of said transferring means;

a crate piling station provided with loading means for re-associating said crates into respective distinct stacks according to the cleanliness degree measured for each of said crates, wherein said piling station is arranged downstream from said measuring station, and wherein said transferring means directly supplies, without any intermediate station or working step, said piling station with crates:

a crate aligning station on said transferring means, in a position up-stream from said measuring station, wherein, down-stream from said measuring station, said crates are moved by said transferring means to the piling station which selectively piles two said crates onto two separate stacks according to the result of the measure of the respective cleanliness detected by said measuring station, wherein, after two previously measured said crate stacks have reached a pre-defined height, or a pre-defined number of crates, each of said crates is transferred to a respective re-assembling station through a respective dedicated transferring means, so that each of said piling station associates a definite number of said stacks, coming from a definite and corresponding area portion of said piling station, to a respective base.

2. Plant according to claim 1, wherein said crate aligning station includes means for the picking-up of successive pairs of said crates placed on the respective distinct stacks, and for placing said pairs on said transferring means, wherein the crates of each of said pair are spatially separated from each other in the direction of the motion of said transferring means.

3. Plant according to claim 2, wherein said successive crate pairs are placed onto said transferring means in substantially the same time.

4. Plant according to claim 3, further comprising:

storing means for receiving and storing one or more data corresponding to respective and pre-defined cleanliness degrees, comparison means for comparing the cleanliness degree measured by said measuring station for each of said crates, with respect to pre-defined said data, and to assign to any of said crates a classification according to the outcome of sad comparison, indexing means for indexing each of said crates with the respective said classification, command and control means for managing said piling station so that each of said crates is placed on a pre-assigned stack according to the respective said classification.

5. Plant according to claim 3, wherein the subsequent stacks of crates having a similar cleanliness degree are formed into a definite area-portion of said piling station.

6. Plant according to claim 2, further comprising:

storing means for receiving and storing one or more data corresponding to respective and pre-defined cleanliness degrees, comparison means for comparing the cleanliness degree measured by said measuring station for each of said crates, with respect to pre-defined said data, and to assign to any of said crates a classification according to the outcome of sad comparison, indexing means for indexing each of said crates with the respective said classification, command and control means for managing said piling station so that each of said crates is placed on a pre-assigned stack according to the respective said classification.

7. Plant according to claim 2, wherein subsequent stacks of crates having a similar cleanliness degree are formed into a definite area-portion of said piling station.

8. Plant according to claim 7, further comprising:

storing means for receiving and storing one or more data corresponding to respective and pre-defined cleanliness degrees, comparison means for comparing the cleanliness degree measured by said measuring station for each of said crates, with respect to pre-defined said data, and to assign to any of said crates a classification according to the outcome of sad comparison, indexing means for indexing each of said crates with the respective said classification, command and control means for managing said piling station so that each of said crates is placed on a pre-assigned stack according to the respective said classification.

9. Plant according to claim 1, wherein a base supply station is arranged, which provides respective bases, through at least selective paths, to said respective re-assembling stations.

10. Plant according to claim 9, wherein said base supply station is accepts bases, coming from said crate aligning station, by respective bases transferring means.

11. Plant according to claim 9, wherein a base loading station is arranged, which accepts bases which are piled on each other, and transfers them, one at a time, to said base-supply station.

12. Plant according to claim 1, wherein a base loading station is arranged, which accepts bases which are piled on each other, and transfers them, one at a time, to a base-supply means.

13. Plant according to claim 1, further comprising:

storing means for receiving and storing one or more data corresponding to respective and pre-defined cleanliness degrees, comparison means for comparing the cleanliness degree measured by said measuring station for each of said crates, with respect to predetermined said data, and to assign to at least one said crate a classification according to the outcome of said comparison, indexing means for indexing each of said crates with the respective said classification, command and control means for managing said piling station so that each of said crates is placed on a pre-assigned stack according to the respective said classification.

14. Plant according to claim 13, wherein said command and control means control said transferring means and said aligning station, said measuring station, said piling station, said re-assembling stations, said base-supply means, and of said base loading station into a pre-determined and integrated way.

15. Plant according to claim 1, wherein said transferring means is a continuous conveyor.

* * * * *